US008859868B2

(12) United States Patent
Dunwoodie

(10) Patent No.: US 8,859,868 B2
(45) Date of Patent: Oct. 14, 2014

(54) DEVICES AND METHODS FOR TUNING A STRINGED INSTRUMENT, SUCH AS A GUITAR OR THE LIKE

(76) Inventor: David Dunwoodie, Delta (CA)

( * ) Notice: Subject to any disclaimer, the term of this patent is extended or adjusted under 35 U.S.C. 154(b) by 163 days.

(21) Appl. No.: 13/384,287

(22) PCT Filed: Mar. 18, 2010

(86) PCT No.: PCT/CA2010/000401

§ 371 (c)(1),
(2), (4) Date: Jan. 16, 2012

(87) PCT Pub. No.: WO2011/006232

PCT Pub. Date: Jan. 20, 2011

(65) Prior Publication Data

US 2012/0111175 A1 May 10, 2012

Related U.S. Application Data

(60) Provisional application No. 61/225,907, filed on Jul. 15, 2009.

(51) Int. Cl.
*G10D 3/14* (2006.01)

(52) U.S. Cl.
CPC ..... *G10D 3/14* (2013.01)
USPC ..... 84/304

(58) Field of Classification Search
USPC ..... 84/304–306
See application file for complete search history.

(56) References Cited

U.S. PATENT DOCUMENTS

2009/0025528 A1* 1/2009 Vochezer ..... 84/304

* cited by examiner

*Primary Examiner* — Kimberly Lockett
(74) *Attorney, Agent, or Firm* — Nexus Law Group LLP

(57) ABSTRACT

String tuning devices for stringed musical instruments, such as guitars or the like, comprising of tuning pegs or machine heads that provide equal or practically equal tuning sensitivity for the strings employed on the same instrument such that a unit of rotation of each tuning peg or machine head produces an equal or practically equal tonal shift in its associated string.

9 Claims, 1 Drawing Sheet

DEVICES AND METHODS FOR TUNING A STRINGED INSTRUMENT, SUCH AS A GUITAR OR THE LIKE

BACKGROUND OF THE INVENTION

1. Field of Invention

The present invention relates to string tensioning devices and methods for stringed musical instruments, such as guitars or the like.

2. Description of Related Art

Stringed musical instruments typically provide a fixed anchor on one end of each string and a mechanism on the other end which allows a user to establish a select amount of tension in the string. The frequency the string oscillates at depends on several parameters such as the vibrating length of the string, its tension, diameter, and material constants. Construction details, such as winding another string around the core string (often found on bass strings) may have also an effect, but mainly contribute to the harmonics content. As is known from physics, the relationship between oscillating frequency and string tension is not linear, but is proportional to the square root of the string tension.

The mechanism used to set the tension of the string is often referred to as the "tuning peg", "tuning machine" or "machine head". A simple embodiment is a tuning peg inserted into the appropriate part of the instrument, typically the neck in guitars, banjos and the like. An extension of the peg typically comprises a cylindrical post around which the string is wound a couple of turns. Rotating the peg rotates the post, which changes the string tension, and thereby changes the oscillating frequency and thus the tuning of the string.

To hold the tune there is first an interference fit of the peg with the body of the instrument. Second, there develops a friction force which resists the string tension back driving the peg. This friction force comes as the result of the string tension inducing a radial force on the peg, which in turn, via the friction coefficient applicable between the material of the peg and the material of the body of the instrument, creates a tangential force, which in turn counter balances the torque that comes as a result of the string tension acting on the radius of the post. Thus, in the absence of willful rotation of the peg, the string tension remains constant unless offsetting forces occur, which can de-tune the string oscillation. This, for instance, may come from age related shrinking of the material from which the instrument is constructed. Among the "offsetting forces" are aging of the instrument body material so that the friction fit loosens.

Another kind tuning mechanism is the tuning machine or machine head, which uses a gear mechanism or a worm gear arrangement, which, by design, provides a self jamming feature if a low pitch or high transmission ratio of the worm gear is implemented. These arrangements are well known in the art. A machine head with a worm gear arrangement is shown in FIG. 1, and typically comprises a tuning handle 2 secured to an end of a worm shaft 4 which extends through a machine head body 6. A worm wheel 8 is meshed with a worm 10 of the worm shaft 4 inside the body 6, and a cylindrical post 12 is connected to the worm wheel 8 and aligned with the rotational axis of the worm wheel 8. The cylindrical post 12 extends to the same side of the neck of the guitar as the strings, and is aligned such that its axis is perpendicular to the strings. In operation, as the tuning handle 2 (hence worm shaft 4) is rotated, it rotates the worm wheel 8, hence the cylindrical post 12. By this, a guitar string that is inserted through a guitar string insertion hole 14 defined in the cylindrical post, is wound or unwound on or from the cylindrical post 12, thereby the guitar string is allowed to be tuned.

In known stringed instruments and the prior art, the diameter of the cylindrical posts of the machine heads or tuning pegs onto which the strings are fastened and wound—and in the case of machine heads, the gear ratios—are the same for all strings used on a given instrument. As a result, the tuning sensitivity, or the amount of tonal change of the string per angular displacement of the cylindrical post, changes from string to string. For example, with some guitars equipped with prior art tuning apparatus having equal cylindrical post diameters (and gear ratios in the case of machine heads), a quarter turn on the tuning peg or tuning handle on the D-string of the guitar may result in a tonal shift of 8 semi-tones, whereas the same quarter turn of the tuning peg or tuning handle on the G-string may result in a tonal shift of 14 semi-tones. This example highlights the significant variance in tuning sensitivity between the strings that is intrinsic to the prior art tuning devices, such as tuning pegs and machine heads.

The variance in tuning sensitivity between the various strings on a stringed instrument can present a significant challenge for a performer in tuning his or her instrument, either before or during a performance, since the strings having a higher tuning sensitivity typically require more iterations of loosening and tightening of the string tension due to easily overshooting the target. Accordingly, it would be advantageous to have machine heads or tuning machines that are equipped to provide equal or substantially equal tuning sensitivity for the strings employed in an ensemble, i.e. on the same instrument.

DESCRIPTION OF THE INVENTION

Accordingly, the present invention addresses the shortcomings of prior art tuning apparatus by providing tuning pegs or machine heads that are equipped to provide equal or substantially equal tuning sensitivity for the strings employed on the same instrument such that a unit of rotation of each tuning peg or machine head produces an equal or substantially equal tonal shift in its associated string. As used herein, the term "substantially equal" in reference to tonal shifts means that the tonal shifts between two strings are within two semitones of each other.

For tuning apparatus represented by a plurality of simple pegs (often found on violins, cellos, ukuleles, some acoustic guitars and the like) the invention provides tuning pegs of varying cylindrical post diameters so that an equal amount of angular displacement on different pegs results in practically the same shift in pitch for the respective string. In other words, if a quarter turn on the tuning peg of the G-string results in a tonal shift representing eight semi-tones, a quarter turn on the tuning peg of the D-string is likewise going to produce a shift of eight semi-tones, or a substantially equal tonal shift that is within two semitones of the eight semitone shift of the G-string (being the reference string in the comparison).

For tuning machines or machine heads that incorporate a gear mechanism, such as for example a worm gear, an additional means of control over the tuning sensitivity is achieved by varying the transmission ratio of the gear mechanism (such as the worm gear). In those situations three choices exist: (a) to solely vary the post diameter to influence the tuning sensitivity; (b) to solely vary the worm gear ratio to control the tuning sensitivity; or (c) to use a combination of post diameter and worm gear ratio to control the tuning sensitivity.

An example of a normalized tuning apparatus for a guitar on which an eighth turn of the tuning head provides a tuning change or tonal shift of four semitones in the associated string is as follows—as expressed by the ratios of the diameter of the cylindrical post of the tuning head on the various strings relative to the diameter of the cylindrical post of the tuning head on the G-string:

TABLE 1

| String | Ratio | Spool/post diameter example (mm) |
|---|---|---|
| E | 3.2 | 12.2 |
| B | 1.8 | 6.9 |
| G | 1.0 | 3.8 |
| D | 1.7 | 6.6 |
| A | 1.6 | 5.9 |
| E | 1.0 | 3.9 |

The above ratios assume a string vibration length (distance between the nut and the saddle) of 640 mm and the following string characteristics:

TABLE 2

| String | String Diameter (mm) | String Core Diameter (mm) |
|---|---|---|
| E | 0.254 | 0.254 |
| B | 0.330 | 0.330 |
| G | 0.432 | 0.432 |
| D | 0.660 | 0.356 |
| A | 0.914 | 0.381 |
| E | 1.168 | 0.406 |

Figure 1:
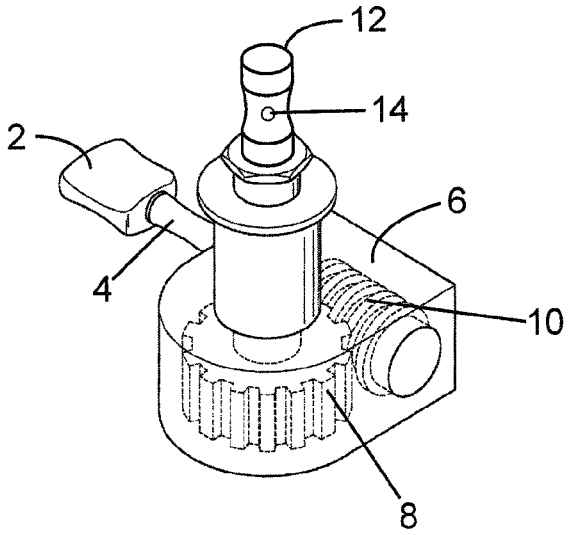
FIG. 1 is a perspective view of a representative prior art machine head.
Figure 2:
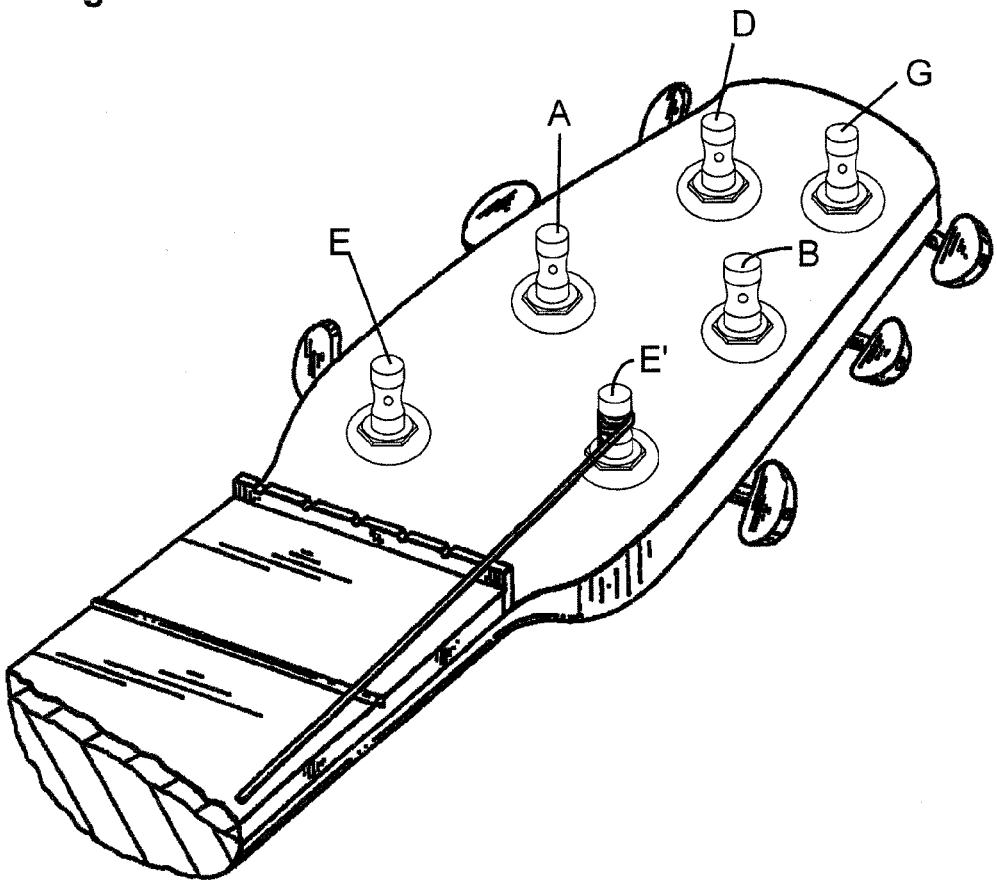
FIG. 2 is a perspective view of a typical guitar headstock showing a set of machine heads mounted therein.

In FIG. 2, the cylindrical posts are labeled with the letter of its corresponding string (the E string corresponding to string number 1 is labeled E'). Thus, machine heads in accordance with the present invention would have cylindrical posts of varying diameters to effect an equal or practically (substantially) equal tonal shift in each string per a specific amount of rotation of the tuning head. For example in accordance with the ratios in Table 1, the post E' is approximately 3.2 times the diameter of the post G; the post B is approximately 1.8 times the diameter of the post G; the post D is approximately 1.7 times the diameter of the post G; the post A is approximately 1.6 times the diameter of the post G; and the post E is approximately the same diameter of the post G.

The above ratios of the diameter of the cylindrical post of the tuning pegs or machine heads on the various strings relative to the diameter of the cylindrical post of the tuning peg or machine head on the G-string will produce a tuning change of four semitones in the associated string for an eighth turn of the tuning head for an ensemble of string having the above characteristic and for string vibration lengths of 640 mm. If different string vibration length is used, or if the strings have different characteristics, then an eighth of a turn of the tuning head is likely to produce a different variance in the tuning change than four semitones, but the tuning change of each string will be substantially the same as the tuning change for the other strings, which still makes it easier for the performer to tune his or her instrument. The diameters of the cylindrical posts of the tuning heads can be sized so as to provide a desired tuning change for a specific revolution of the tuning head, and as long as the ratios are substantially the same as those in Table 1, the change in tune of each string per unit of revolution of its tuning head would be substantially the same for all strings.

The above example provides a normalized tuning apparatus for a guitar based on varying the diameters of the cylindrical post of tuning heads within certain ratios; however, the same objective may be accomplished by varying the gear ratios between the worm gear and the worm wheel in a worm gear tuning machine arrangement.

The present invention also addresses the shortcomings of prior art by providing a method of achieving an equal or substantially equal tonal shift in each string of an ensemble of strings by providing a tuning apparatus in having varying diameters of the cylindrical posts of the tuning machines so that a unit of rotation of each tuning machine results is a desired tonal shift in its associated string. The diameters of the cylindrical posts for the strings on a guitar may be in the ratios provided in Table 1. Alternatively, in devices based on a gear mechanism such as a worm gear arrangement, the achieving of an equal or substantially equal tonal shift in each string of an ensemble of strings may be accomplished by (a) varying the post diameter to influence the tuning sensitivity; (b) varying the worm gear ratio to control the tuning sensitivity; or (c) using a combination of post diameter and worm gear ratio to control the tuning sensitivity.

It is understood that the embodiments described and illustrated herein are merely illustrative of embodiments of the present invention. Other embodiments that would occur to those skilled in the art are contemplated within the scope of the present invention. Thus, the embodiments described and illustrated herein should not be considered to limit the invention as construed in accordance with the accompanying claims.

The invention claimed is:

1. A stringed instrument comprising a plurality of tuning pegs, each having a rotatable cylindrical post around which a portion of a string of the instrument is wound, wherein the cylindrical posts of at least some of the tuning pegs vary in diameter in a manner such that a unit of rotation of each tuning peg produces an equal or substantially equal tonal shift in its associated string.

2. The device of claim 1 wherein the stringed instrument is a guitar having strings E, B, G, D, A and E, wherein ratios of the diameter of the cylindrical post of the tuning pegs associated with the strings E, B, D, A and E relative to the diameter of the cylindrical post of the tuning peg associated with the G-string are as follows:

| String | Ratio |
|---|---|
| E | 3.2 |
| B | 1.8 |
| G | 1.0 |
| D | 1.7 |
| A | 1.6 |
| E | 1.0. |

3. The device of claim 2 wherein the guitar includes a nut and a saddle, and the distance between the nut and the saddle is 64 cm, wherein an eighth turn of any of the tuning pegs produces a tonal shift of four semitones in the associated string.

4. A kit of machine heads for a stringed instrument, wherein each machine head is associated with a string and comprises a rotatable handle connected to a gear mechanism that defines a transmission ratio and that is connected to a rotatable cylindrical post defining a post diameter around which a portion of the string is wound, wherein one or a combination of:

a. the post diameter of the cylindrical posts; and b. the transmission ratios of the gear mechanisms of at least some of the machine heads vary in a manner such that a unit of rotation of the handle of each machine head produces an equal or substantially equal tonal shift in its associated string.

5. A kit of machine heads for a guitar having strings E, B, G, D, A and E, each machine head comprising a rotatable handle connected to a gear mechanism that is connected to a rotatable cylindrical post defining a post diameter around which a portion of one of said strings is wound, wherein ratios of the post diameter of the cylindrical post of the machine heads associated with strings E, B, D, A and E relative to the post diameter of the cylindrical post of the machine head associated with the G-string are as follows:

| String | Ratio |
|---|---|
| E | 3.2 |
| B | 1.8 |
| G | 1.0 |
| D | 1.7 |
| A | 1.6 |
| E | 1.0 |

such that a unit of rotation of the handle of each machine head produces an equal or substantially equal tonal shift in its associated string.

6. A stringed instrument comprising a plurality of machine heads, each machine head comprising a rotatable handle connected to a gear mechanism that defines a transmission ratio and that is connected to a rotatable cylindrical post defining a post diameter around which a portion of a string of the instrument is wound, wherein one or a combination of:

a. the post diameter of the cylindrical posts; and b. the transmission ratios of the gear mechanisms of at least some of the machine heads vary in a manner such that a unit of rotation of the handle of each machine head produces an equal or substantially equal tonal shift in its associated string.

7. A guitar having strings E, B, G, D, A and E and a machine head associated with each string, each machine head comprising a rotatable handle connected to a gear mechanism that is connected to a rotatable cylindrical post around which a portion of its associated string is wound, wherein ratios of the diameter of the cylindrical post of the machine heads associated with strings E, B, D, A and E relative to the diameter of the cylindrical post of the machine head associated with the G-string are as follows:

| String | Ratio |
|---|---|
| E | 3.2 |
| B | 1.8 |
| G | 1.0 |
| D | 1.7 |
| A | 1.6 |
| E | 1.0. |

such that a unit of rotation of each handle of a machine head produces an equal or substantially equal tonal shift in its associated string.

8. A method of tuning a stringed instrument comprising the steps of providing a plurality of tuning pegs in the instrument, each having a rotatable cylindrical post around which a portion of a string of the instrument is wound, wherein the cylindrical posts of at least some of the tuning pegs vary in diameter in a manner such that a unit of rotation of each tuning peg produces an equal or substantially equal tonal shift in its associated string; and turning at least one of the tuning pegs by a unit of rotation to effect a tonal shift in its associated string.

9. A method of tuning a stringed instrument comprising the steps of providing a plurality of machine heads, each machine head comprising a rotatable handle connected to a gear mechanism that defines a transmission ratio and that is connected to a rotatable cylindrical post defining a post diameter around which a portion of a string of the instrument is wound, wherein one or a combination of (a) the post diameter of the cylindrical posts and (b) the transmission ratios of the gear mechanisms of at least some of the machine heads vary in a manner such that a unit of rotation of the handle of each machine head produces an equal or substantially equal tonal shift in its associated string; and turning the handle of at least one of the machine heads by a unit of rotation to effect a tonal shift in its associated string.

* * * * *